US007740132B2

(12) United States Patent
Oono et al.

(10) Patent No.: US 7,740,132 B2
(45) Date of Patent: Jun. 22, 2010

(54) CONTAINER FOR SHEET PRODUCTS

(75) Inventors: Masahiro Oono, Ageo (JP); Hiroshi Kitsutaka, Yotsukaido (JP)

(73) Assignee: Otsuka Pharmaceutical Co., Ltd., Tokyo (JP)

( * ) Notice: Subject to any disclaimer, the term of this patent is extended or adjusted under 35 U.S.C. 154(b) by 979 days.

(21) Appl. No.: 10/584,282

(22) PCT Filed: Jan. 20, 2005

(86) PCT No.: PCT/JP2005/000648

§ 371 (c)(1),
(2), (4) Date: Jun. 26, 2006

(87) PCT Pub. No.: WO2005/070786

PCT Pub. Date: Aug. 4, 2005

(65) Prior Publication Data

US 2009/0065390 A1 Mar. 12, 2009

(30) Foreign Application Priority Data

Jan. 26, 2004 (JP) ..... 2004-017509
Sep. 3, 2004 (JP) ..... 2004-257346

(51) Int. Cl.
*A45C 11/18* (2006.01)

(52) U.S. Cl. ..... 206/39.4; 206/804; 426/106

(58) Field of Classification Search ..... 221/151, 221/152, 210, 220, 255, 259, 209, 245, 246, 221/261, 268, 271, 232; 206/39, 39.4, 804, 206/425, 555; 426/106, 110
See application file for complete search history.

(56) References Cited

U.S. PATENT DOCUMENTS 4,784,556 A * 11/1988 Ackeret ..... 414/788.8

(Continued)

FOREIGN PATENT DOCUMENTS

JP 02-34486 U 3/1990

(Continued)

OTHER PUBLICATIONS

Microfilm of the specification and drawings annexed to the request of Japanese Utility Model Application No. 139486/1979 (Laid-Open No. 56778/1981) (Yoshino Kogyosho Co., Ltd.) May 16, 1981.

(Continued)

*Primary Examiner*—Jacob K Ackun, Jr.
(74) *Attorney, Agent, or Firm*—Sughrue Mion, PLLC

(57) ABSTRACT

The present invention relates to a container for sheet products that makes it easy to take out each individual piece of the sheet products stacked in the container. The container having a tray-like container body (2), an opening/closing lid (3) that is slidably mounted on the container body (2), a pressing member (5) elastically pressing the sheet products (4) stored in the container (1) toward the inner surface of the opening/closing lid (3), a friction drag member (7) that is installed on the inner surface of the opening/closing lid (3) to feed out the sheet products (4) according to the closing operation of the opening/closing lid (3), and a stopper (6) formed in the container body (2) to stop the backward movement of the sheet products (4) by the friction drag member (7) when the opening/closing lid (3) is opened.

6 Claims, 10 Drawing Sheets

U.S. PATENT DOCUMENTS

| | | | | |
|---|---|---|---|---|
| 6,068,157 | A * | 5/2000 | Kamiya | 221/36 |
| 7,287,666 | B2 * | 10/2007 | De Laforcade | 221/65 |
| 2003/0106900 | A1 * | 6/2003 | Storz | 221/259 |

FOREIGN PATENT DOCUMENTS

| | | | |
|---|---|---|---|
| JP | 05-22380 | U | 3/1993 |
| JP | 07-38204 | Y2 | 8/1995 |
| JP | 2527511 | Y2 | 5/1997 |
| JP | D1001472 | S | 1/1998 |
| JP | 10-175389 | A | 6/1998 |

OTHER PUBLICATIONS

Microfilm of the specification and drawings annexed to the request of Japanese Utility Model Application No. 51359/1986 (Laid-Open No. 161675/1987) (Nitto Seiki Kabushiki Kaisha) Oct. 14, 1987.

Microfilm of the specification and drawings annexed to the request of Japanese Utility Model Application No. 141588/1986 (Laid-Open No. 46386/1988) (Yoshino Kogyosho Co., Ltd.) Mar. 29, 1988.

* cited by examiner

CONTAINER FOR SHEET PRODUCTS

This Application is a 371 of PCT/JP2005/000648, filed Jan. 20, 2005; the disclosure of which is incorporated herein by reference.

TECHNICAL FIELD

The present invention relates to a container for sheet products that makes it easy to remove edible films, oil absorbing papers and like sheet products stacked in the container.

BACKGROUND OF THE INVENTION

Heretofore, a container having an opening/closing lid on the right or left side of the top of a thin rectangular case (see, for example, patent document 1), and a container having a case body and a slidable lid, wherein the lid is opened or closed by sliding the slidable lid (see, for example, patent document 2) have been known as a container for sheet products.

[Patent document 1] Design registered No. 1001472

[Patent document 2] Japanese Unexamined Utility Model Publication No. 1995-38204

SUMMARY OF THE INVENTION

Problem to be Solved by the Invention

However, it is often difficult to remove each piece of sheet products from such conventional containers.

For example, ordinary edible films are water-soluble and have a thickness of 30 to 55 μm. Since such films usually have smooth and slick surfaces, it is often difficult to remove them with dry fingers, and therefore users often dampen their fingers by licking them, etc., before removing the product from the container. However, when the topmost edible film gets wet, the edible films beneath it also get wet, and a plurality of stacked edible films may end up sticking together. This often makes it difficult to remove each sheet. Furthermore, since edible films are usually very thin and slippery as described above, they are inherently difficult to remove one by one.

For example, since oil absorbing papers have smooth surfaces and are slippery when held with dry fingers, it is very difficult to remove each piece from a stacked condition.

In light of the above problem, one of the main objects of the present invention is to provide a container for sheet products wherein each of the sheet products stacked therein can be easily removed.

Means for Solving the Problem

The above object can be achieved by a container having a tray-like container body, an opening/closing lid slidably mounted on the container body, a pressing member elastically pressing the sheet products stacked in the container toward the inner surface of the opening/closing lid, a friction drag member disposed on the inner surface of the opening/closing lid to feed out the sheet products in accordance with the closing operation of the opening/closing lid, and a stopper formed in the container body to stop the backward movement of the sheet products by the friction drag member when the opening/closing lid is opened.

EFFECT OF THE INVENTION

Because the container for sheet products of the present invention has the above structure, by pressing the stacked sheet products toward the inner side of the opening/closing lid with the pressing member, the frictional force generated between the friction drag member disposed in the inner side of the opening/closing lid and the topmost sheet product is increased, and the topmost sheet product is shifted in accordance with the opening/closing movement of the opening/closing lid.

Backward movement of the sheet products due to the opening movement of the opening/closing lid is blocked by the stopper, and the topmost stacked sheet product is removed from the container by the forward movement of the sheet products due to the closing operation subsequent to the opening movement of the opening/closing lid.

As described above, the topmost sheet product stacked in the container for sheet products can be easily removed by simply opening or closing the opening/closing lid.

EXPLANATION OF NUMERICAL SYMBOLS

Figure 1:
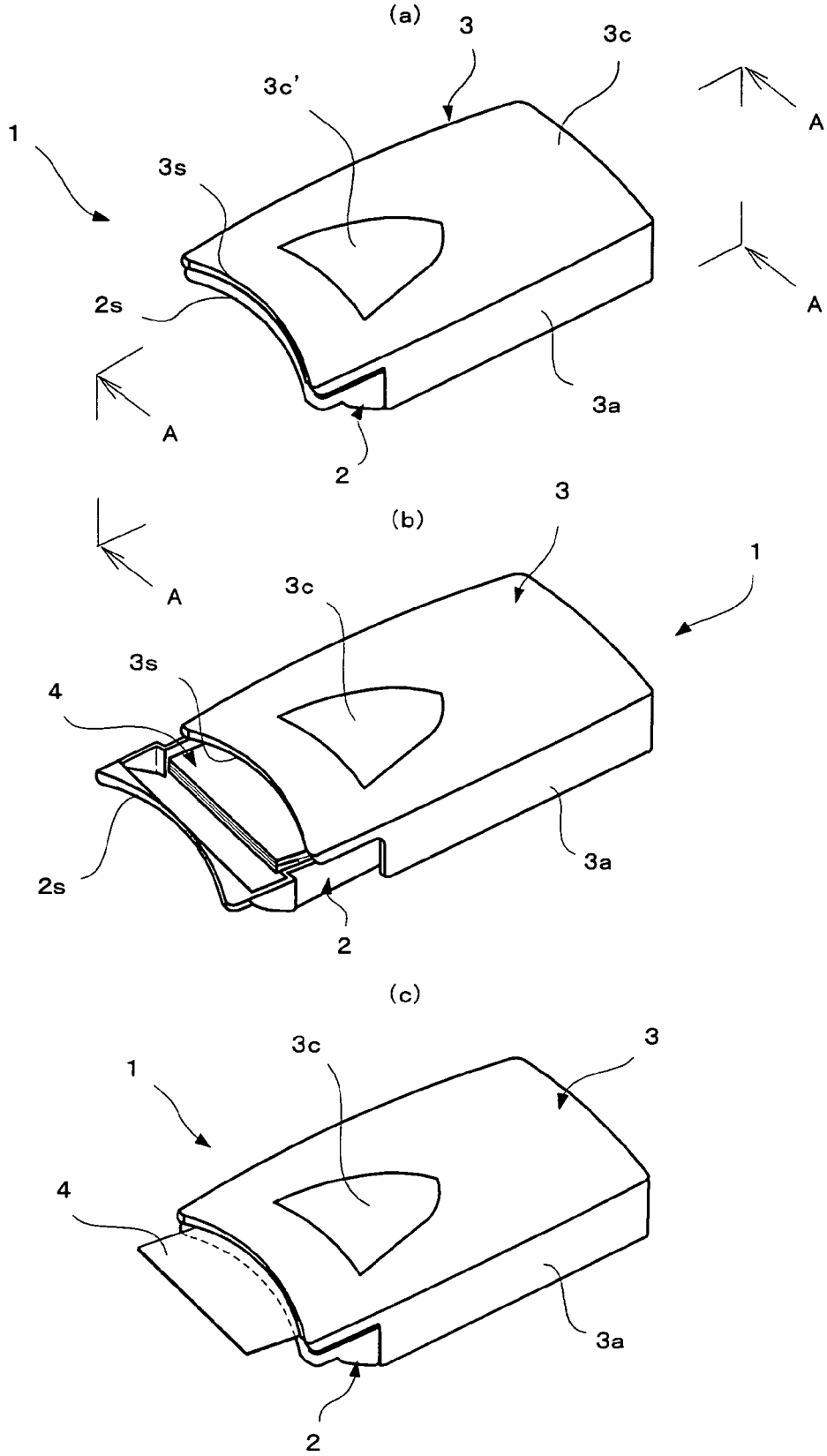
FIG. 1 is a perspective view showing the container for sheet products according to the first embodiment of the present invention, wherein FIG. 1(*a*) shows an initial condition when the opening/closing lid is closed, FIG. 1(*b*) shows the condition when the opening/closing lid is opened from the condition shown by FIG. 1(*a*), and FIG. 1(*c*) shows the condition when the opening/closing lid is closed from the condition shown by FIG. 1(*b*).

1, 1' container for sheet products
2, 2' container body
3, 3' opening/closing lid
4 sheet products
5, 5' pressing member
5*a* attaching end portion
5*b* slanting portion
5*c* pressing portion
6, 6' stopper (partition)
7 friction drag member
8 engaging convex portion

BEST MODE FOR CARRYING OUT THE INVENTION

Hereunder, the first embodiment of the container for sheet products of the present invention is explained with reference to FIGS. 1 to 5. Note that the same components have the same numerical symbols in all of the embodiments and figures described below.

A container for sheet products 1 has an opening/closing lid 3 disposed on a tray-like container body 2. The opening/closing lid 3 has projecting bars 3*b* (see FIG. 3) each on the inner side of the bottom ends of the side pieces 3*a* and concave grooves 2*a* (see FIG. 4(*c*)) in which the projecting bars 3*b* of the side pieces 3*a* are fitted on the outer side pieces of the bottom ends of the container body 2. Because the projecting bars 3*b* loosely fit in the concave grooves 2*a*, the opening/closing lid 3 is slidably mounted on the container body 2. By sliding the opening/closing lid 3 relative to the container body 2, the opening/closing lid 3 is opened and closed. In order to ease the opening and closing operation, a concave portion 3*c*' may be formed in the top 3*c* of the opening/closing lid 3 so that a portion of the user's finger can be placed in the opening/closing lid 3.

The container body 2 has a pressing member 5 for resiliently pressing the stocked sheet products 4 toward the inner surface of the opening/closing lid 3. The sheet products 4 may be, for example, edible films, oil absorbing papers, etc. Note that the thickness of edible films is generally, 1 to 2000 μm, and preferably 30 to 55 μm. The edible films are not limited to foods, and include medical products.

Figure 4:
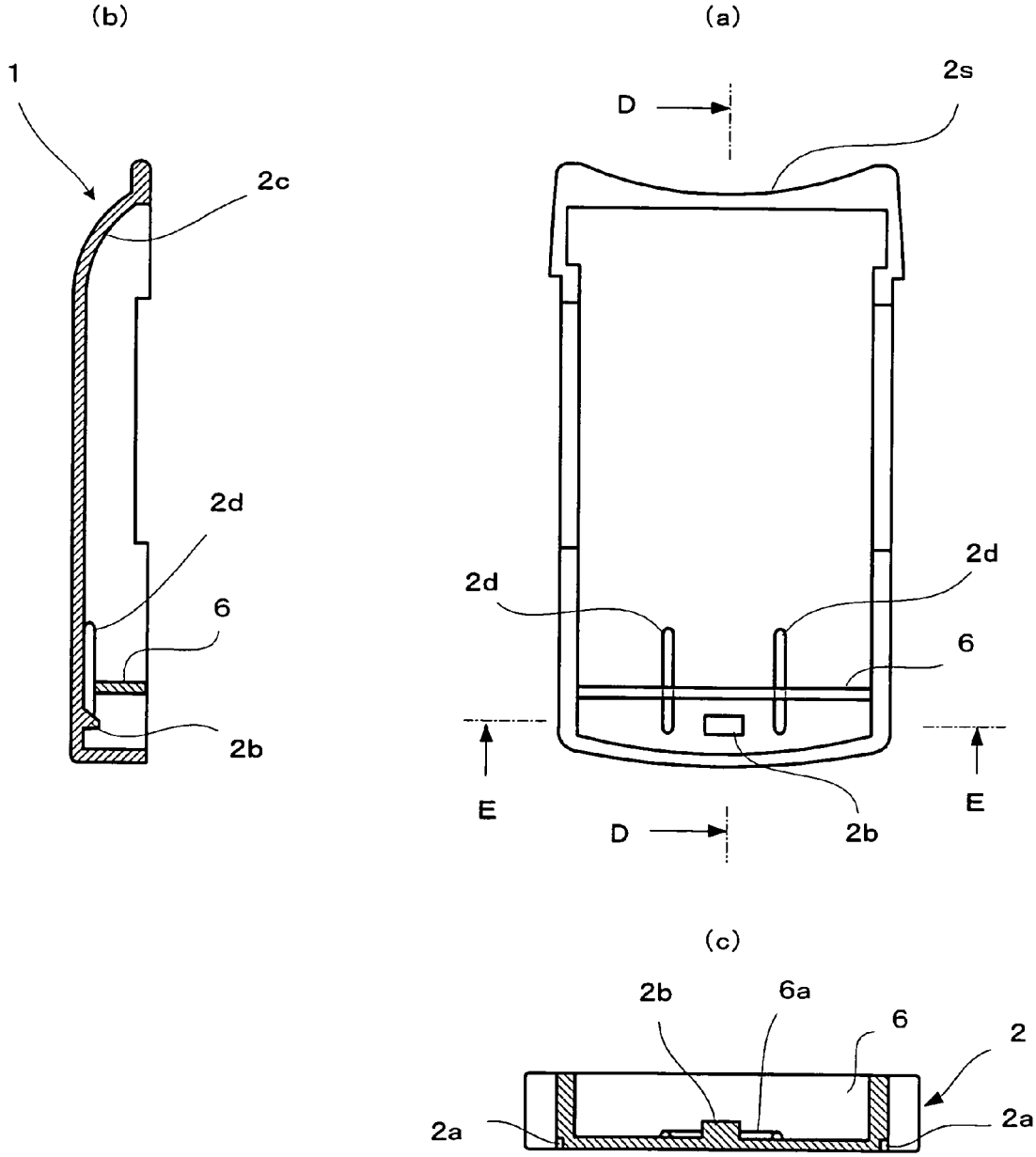
FIG. 4 shows the container body, which is a constituent component of the container for sheet products of FIG. 1, wherein FIG. 4(*a*) is a plan view, FIG. 4(*b*) is a cross-sectional view of FIG. 4(*a*) taken along the line D-D, and FIG. 4(*c*) is a cross-sectional view of FIG. 4(*a*) taken along the line E-E.

A partition 6 is formed in the container body 2, and a slit 6*a* (see FIG. 4(*c*)) is formed near the center of the bottom end of the partition 6. A locking-projecting portion 2*b* is formed in the vicinity of the slit 6*a* in the bottom surface of the container body 2.

Figure 2:
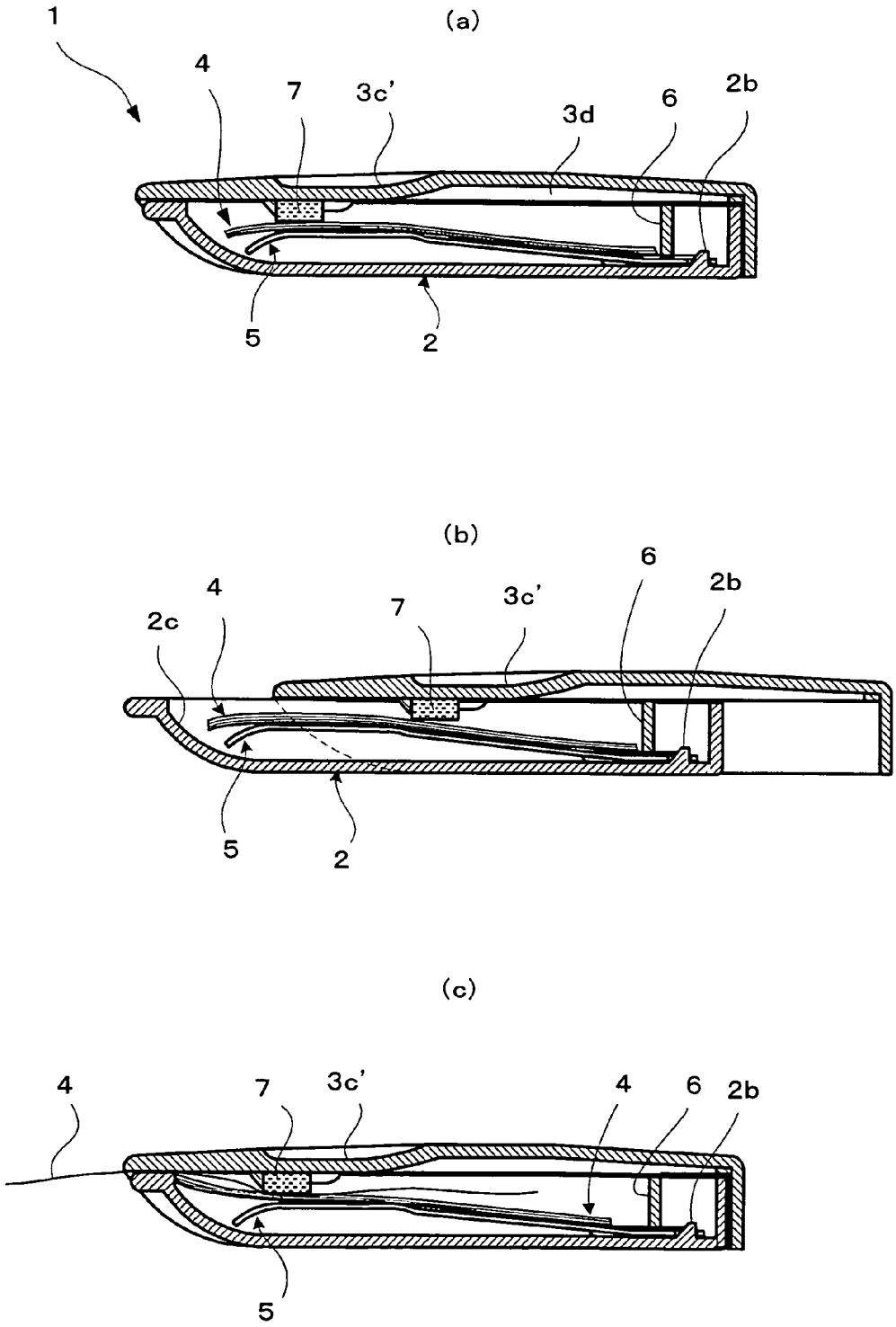
FIG. 2 is a cross-sectional view of the container of FIG. 1 taken along the line A-A, wherein FIGS. 2(*a*) to (*c*) correspond to FIGS. 1(*a*) to (*c*) respectively.
Figure 3:
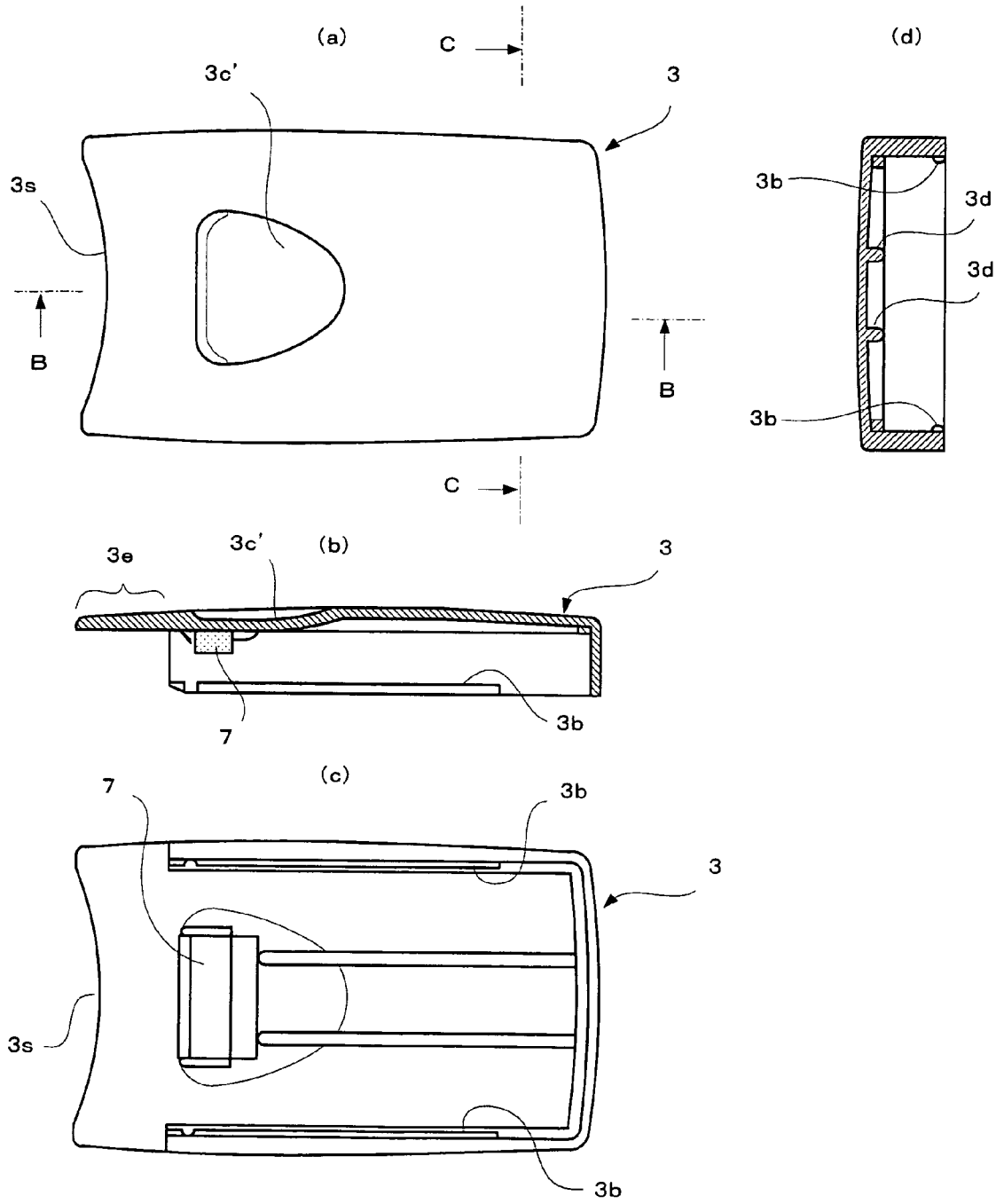
FIG. 3 shows the opening/closing lid, which is a constituent component of the container for sheet products of FIG. 1, wherein FIG. 3(*a*) is a plan view, FIG. 3(*b*) is a cross-sectional view of FIG. 3(*a*) taken along the line B-B, FIG. 3(*c*) is a bottom plan view, and FIG. 3(*d*) is a cross-sectional view of FIG. 3(*a*) taken along the line C-C.
Figure 5:
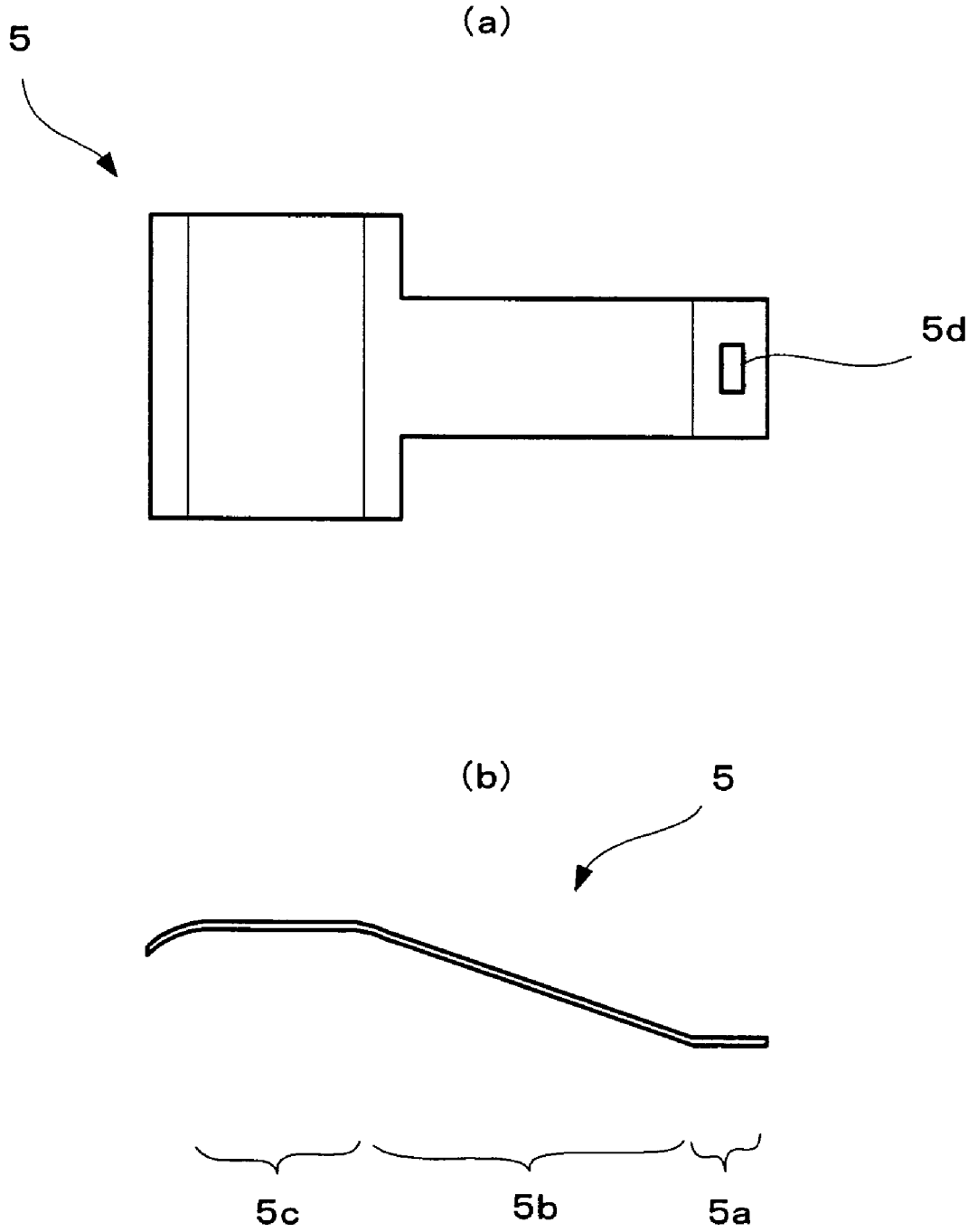
FIG. 5 shows a pressing member, which is a constituent component of the container for sheet products of FIG. 1, wherein FIG. 5(*a*) is a plan view, and FIG. 5(*b*) is a side elevation view.
Figure 6:
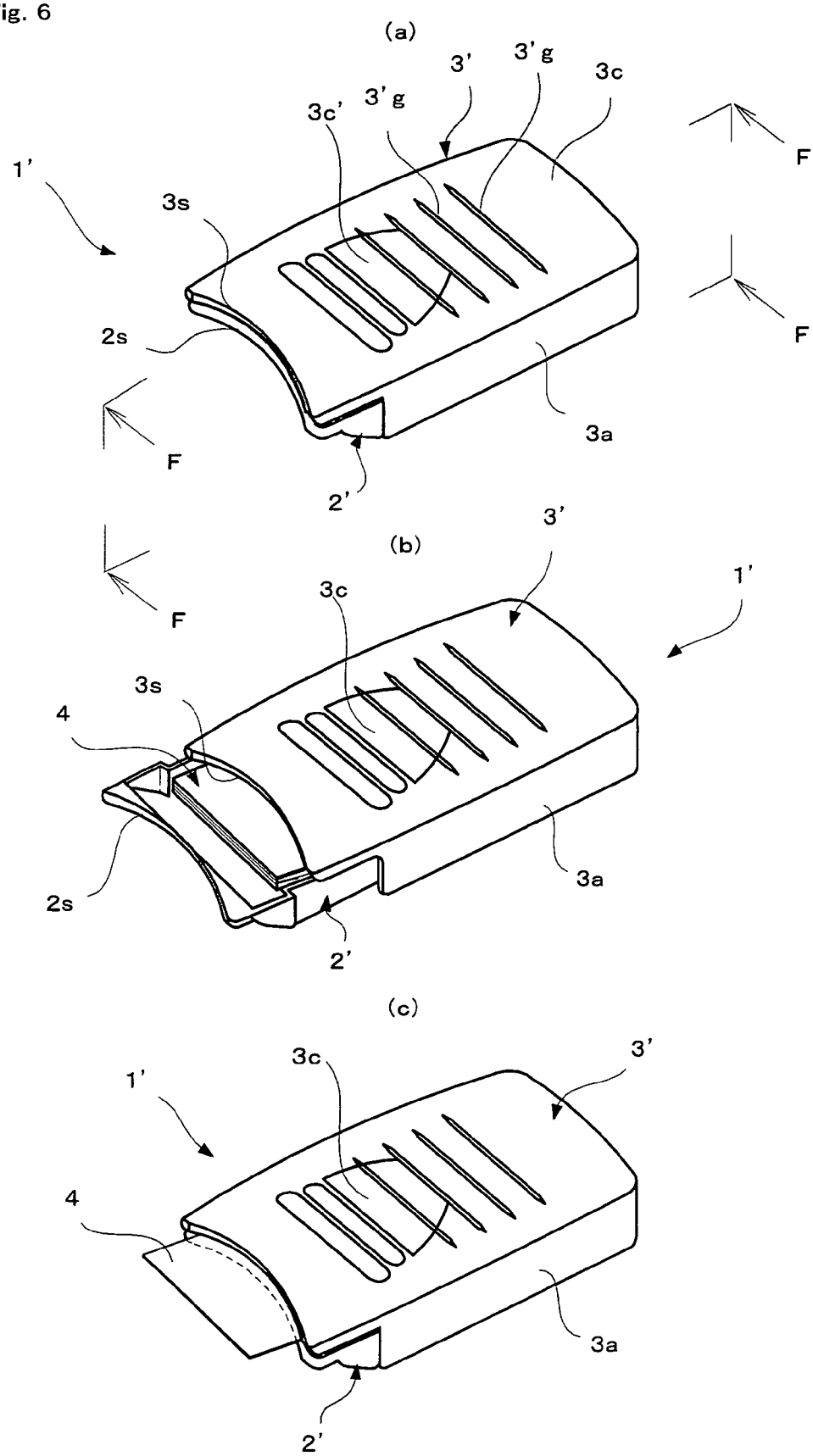
FIG. 6 is a perspective view showing the container for sheet products according to the second embodiment of the present invention, wherein FIG. 6(*a*) shows an initial condition when the opening/closing lid is closed, FIG. 6(*b*) shows the condition when the opening/closing lid is opened from the condition shown by FIG. 6(*a*), and FIG. 6(*c*) shows the condition when the opening/closing lid is closed from the condition shown by FIG. 6(*b*).

The pressing member 5 is formed as a plate spring in the example shown in the figures. Such a plate spring may be formed from plastic sheet and like flexible sheet materials having smooth surfaces. The plate spring that forms the pressing member 5 has an attaching end portion 5*a* disposed on the bottom of the container body 2, a slanting portion 5*b* slantingly extending from the attaching end portion 5*a*, and a pressing portion 5*c* attached to the top of the slanting portion 5*b* as shown in FIGS. 2 and 5.

An engaging hole 5*d* (FIG. 5) is formed in the attaching end portion 5*a*. By putting the attaching end portion 5*a* through the slit 6*a* to insert the locking projecting portion 2*b* in the engaging hole 5*d*, the plate spring forming the pressing member 5 is fixed to the container body 2 (see FIG. 2). In FIG. 4, numerical symbol 2*d* indicates a guiding rib for guiding the attaching end portion 5*a*.

The slanting portion 5*b* of the plate spring forming the pressing member 5 slants so as to rise from the attaching end portion 5*a* to the opening/closing end. The top of the slanting portion 5*b* is formed as a smooth surface that can be disposed substantially parallel to the sliding direction of the friction drag member 7, and the smooth surface forms the pressing portion 5*c* that presses the sheet products 4 toward the opening/closing lid 3. The top of the pressing portion 5*c* has a free end.

A friction drag member 7 formed from a polypropylene-based resin that is usable for storing foods is disposed on the inner side of the opening/closing lid 3. The friction drag member 7 may be formed such that it is united with the opening/closing lid 3. The friction drag member 7 is formed from a material and has a configuration selected so that the coefficient of friction between the friction drag member 7 and the sheet products is greater than that between each of the stacked sheet products. Therefore, the friction drag member 7 is subject to friction as it engages the sheet products 4 and can move the sheet products 4 backward or forward in accordance with the opening/closing movement of the opening/closing lid 3. In this case, since the frictional force generated between the friction drag member 7 and sheet products 4 is greater than that between the sheet product to be removed and the sheet products immediately below it, the force to move the sheet products below the topmost sheet product is small, and therefore the sheet products below the topmost sheet product cannot be removed from the container body even when shifted, since they come in contact with the front end of the inner side of the container body 2.

The friction drag member 7 is disposed in the vicinity of the opening/closing end of the opening/closing lid 3. In the example shown in the figures, the friction drag member 7 is disposed so as to face the pressing portion 5*c* when the lid is closed. When the location where the friction drag member 7 is disposed comes closer to the opening/closing end of the opening/closing lid 3, the distance over which the sheet product 4 is sent out can be made greater.

Furthermore, the container body 2 has a stopper for blocking the backward movement of the sheet products 4. In the example shown in the figures, the partition 6 rises from the bottom of the container body 2 to a height such that the partition 6 can come into contact with the parallel ribs 3*d* (see FIG. 3(*d*)) formed on the inner wall surface of the opening/closing lid 3, so that the partition 6 can function as a stopper. As shown in FIG. 2(*b*), when the opening/closing lid 3 is opened, among the stacked sheet products, the topmost sheet product 4 that is in contact with the friction drag member 7 would move backward due to the opening movement of the opening/closing lid 3; however, the partition 6 that functions as a stopper blocks that movement. Although not shown in the figures, it is also possible to remove the partition 6 and form a stopper using, for example, a portion of the rear inner wall surface of the container body 2.

The stopper can also function as a stopper that prevents the opening/closing lid 3 from being removed from the container body 2. In the example shown in the figures, the friction drag member 7 is provided so as to project toward the back surface of the opening/closing lid 3, and when the opening/closing lid 3 is slid open, the friction drag member 7 comes in contact with the partition 6 so that the opening/closing lid 3 will not open any further. Note that, in addition to the friction drag member 7, a locking convex portion (not shown) is disposed on the back surface of the opening/closing lid 3, so that the locking convex portion can prevent the opening/closing lid 3 from being removed.

In the example shown in the figures, as is clear from FIG. 2(*b*), in the pressing portion 5*c*, which has a flat surface, the topmost stacked sheet product 4 is pressed against the friction drag member 7 by the pressing portion 5*c*. When the friction drag member 7 comes near the slanting portion 5*b* beyond the pressing portion 5*c* by further opening the opening/closing lid 3, since the slanting portion 5*b* moves away from the friction drag member 7 as the opening/closing lid 3 is moved in the opening direction, the friction between the sheet product 4 and friction drag member 7 becomes smaller in accordance with the degree to which the opening/closing lid 3 is opened, and the frictional force eventually has no effect.

When the opening/closing lid 3 is closed from the opening condition, as shown in FIGS. 1(*c*) and 2(*c*), the topmost sheet product 4 is sent out in accordance with the closing operation by the friction drag member 7. In the example shown in the figures, the amount (length) sent out depends on the degree of the inclination of the slanting portion 5*b* of the plate spring that forms the pressing member 5, but mainly depends on the length of the pressing portion 5*c*.

The container body 2 has a tapered surface 2*c* (see FIG. 4(*b*)) so that the opening/closing end of the container body 2 is shallower. The sheet product 4 to be taken out by the closing operation of the opening/closing lid 3 is guided along the tapered surface 2*c*, and removed from the space between the opening/closing lid 3 and container body 2.

When the opening/closing lid 3 is completely closed, as shown in FIGS. 1(*c*) and 2(*c*), a portion of the sheet products 4 juts out. In this condition, the sheet products 4 are sandwiched between the container body 2 and the opening/closing lid 3; however, the container is designed so that the sandwiching force does not hinder the sheet products 4 from being removed.

Therefore, as in the example shown in the figures, the side pieces 3*a*, 3*a* on which the projecting bars 3*b* of the opening/closing lid 3 are formed can be disposed so they do not extend to the opening/closing end but are held in a location set back from the end. In other words, the opening/closing lid 3 can form a tongue piece 3*e* (see FIG. 3(*b*)) only from the top 3*c* at the opening/closing end, and by providing no side pieces 3*a*, the top 3*c* has flexibility at the opening/closing end in the direction in which the tongue piece 3*e* moves away from the container body 2. By providing flexibility to the tongue piece 3*e*, the sheet product 4 removed by the opening and closing operation of the opening/closing lid 3 can be easily removed from the space between the tongue piece 3*e* and container body 2.

This structure can weaken the force by which the sheet products are sandwiched between the tongue piece of the opening/closing lid 3 and the container body 2, and therefore the sheet products can be easily removed. It is preferable that the container body 2 and opening/closing lid 3 be formed from plastic materials having a smooth surface with a small coefficient of friction. In this embodiment, the container body 2 and opening/closing lid 3 are formed from polypropylene.

The portion of the sheet products 4 that juts out from the container for sheet products 1 may be pulled out using the fingers or by being sandwiched between the lips. In particular, when the fingers are soiled and such a product is removed by being sandwiched between the lips, it is advantageous that the sheet products be orally taken as edible films from the viewpoint of good hygiene.

If the container body 2 and the side edges 2*s*, 3*s* of the opening/closing end of the opening/closing lid 3 are formed to have a concave shape as seen in a plan view, as in the example shown in the figures, the product can be easily sandwiched between the lips and removed.

In the first embodiment, it is also possible to form the pressing member 5 in an integrated manner with the container body 2 so that the pressing member 5 does not come off from the container body 2.

The second embodiment of the container for sheet products of the present invention is explained below with reference to FIGS. 6 to 10. FIGS. 6 to 10 correspond to FIGS. 1 to 5 of the first embodiment.

The pressing member 5 is structured so as to constantly press the sheet products 4 toward the opening/closing lid 3 in the first embodiment; however, in the container for sheet products 1' of the second embodiment, the pressing member 5' is structured so as to work together with the opening/closing lid 3' and to press the sheet products 4 toward the opening/closing lid 3' when the opening/closing lid 3' is in a predetermined range of the opened position. The second embodiment is thus different from the first embodiment in this respect. Specifically, the second embodiment has the following structure. Note that the same numerical symbols are used for the same constituent components of the first embodiment, and a detailed explanation thereof is thus omitted.

The pressing member 5' has an L-like shape as seen in a side view and is provided with a rising portion 5'*e* that rises from the bottom surface of the container body 2', and an extending portion 5'*f* that extends from the bottom end of the rising portion 5'*e* toward the bottom surface of the container body 2'. The extending portion 5'*f* is formed to have a an upside-down V shape as seen in a side view, wherein a wide rectangular portion is connected to a narrow rectangular portion as seen in a plan view. The wide rectangular portion corresponds to the pressing portion in the first embodiment.

The pressing member 5' is not fixed to the container body 2' and is rotatable around a tangent between the bottom surface of the container body 2' and the bottom end of the rising portion 5'*e* that serves as its rotation axis. Such a rotation movement of the pressing member 5' shifts the extending portion 5'*f* upwardly from the bottom surface of the container body 2' toward the friction drag member 7, and the sheet products 4 are thereby pressed against the friction drag member 7.

In the example shown in the figures, the extending portion 5'*f* passes through the space X between the two standing partitions 6'. Since the rising portion 5'*e* has a width that is greater than that of space X, the movement of the pressing member 5' in the opening/closing direction of the opening/closing lid is limited. Between the partition 6' and rear side surface of the container body 2', in order to make the extending portion 5'*f* press the sheet products 4 toward the friction drag member 7, at least a space is formed where the rising portion 5'*e* can slant.

Although not shown, it is also possible to limit the shift of the elastic member in the opening/closing direction of the opening/closing lid by forming an opening in the extending portion 5'*f* and making the partition pass through the opening. It is also possible to provide a rotatable bearing on the bottom surface of the container body 2' to rotatably attach the pressing member 5'.

The pressing member 5', which functions as a plate spring, is formed of plastic, etc., wherein at least the extending portion 5'*f* is formed into a thin plate. Furthermore, the extending portion 5'*f* is longer than the rising portion 5'*e*, and the center of gravity of the pressing member 5' is located in the vicinity of the extending portion 5'*f*, and therefore the pressing member 5', prior to rotating, can maintain the condition wherein the extending portion 5'*f* is disposed on the bottom surface of the container body 2'.

Figure 7:
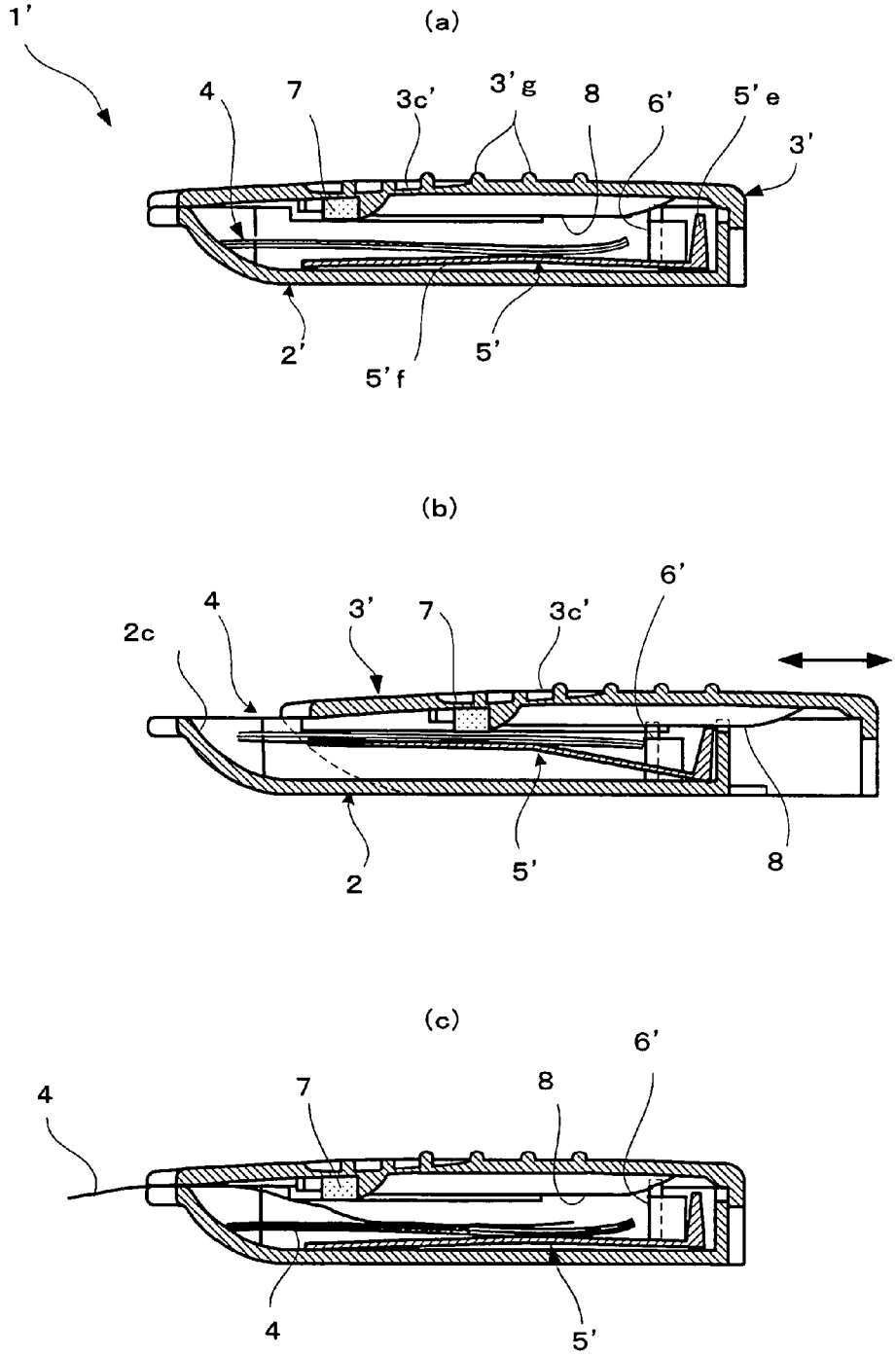
FIG. 7 is a cross-sectional view of the container of FIG. 6 taken along the line F-F, wherein FIGS. 7(*a*) to (*c*) correspond to FIGS. 6(*a*) to (*c*) respectively.
Figure 8:
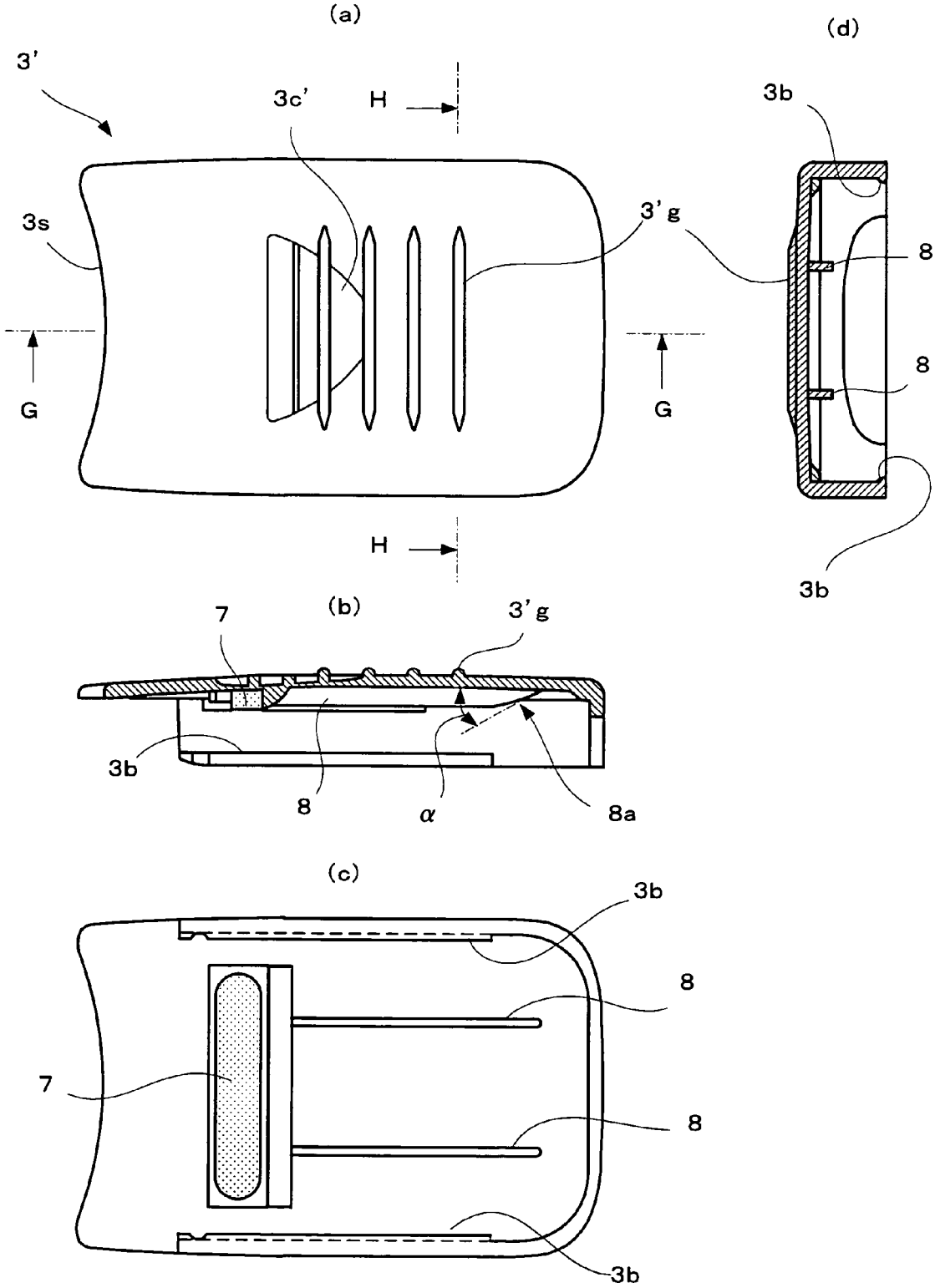
FIG. 8 shows the opening/closing lid, which is a constituent component of the container for sheet products of FIG. 6, wherein FIG. 8(*a*) is a plan view, FIG. 8(*b*) is a cross-sectional view of FIG. 8(*a*) taken along the line G-G, FIG. 8(*c*) is a bottom plan view, and FIG. 8(*d*) is a cross-sectional view of FIG. 8(*a*) taken along the line H-H.
Figure 9:
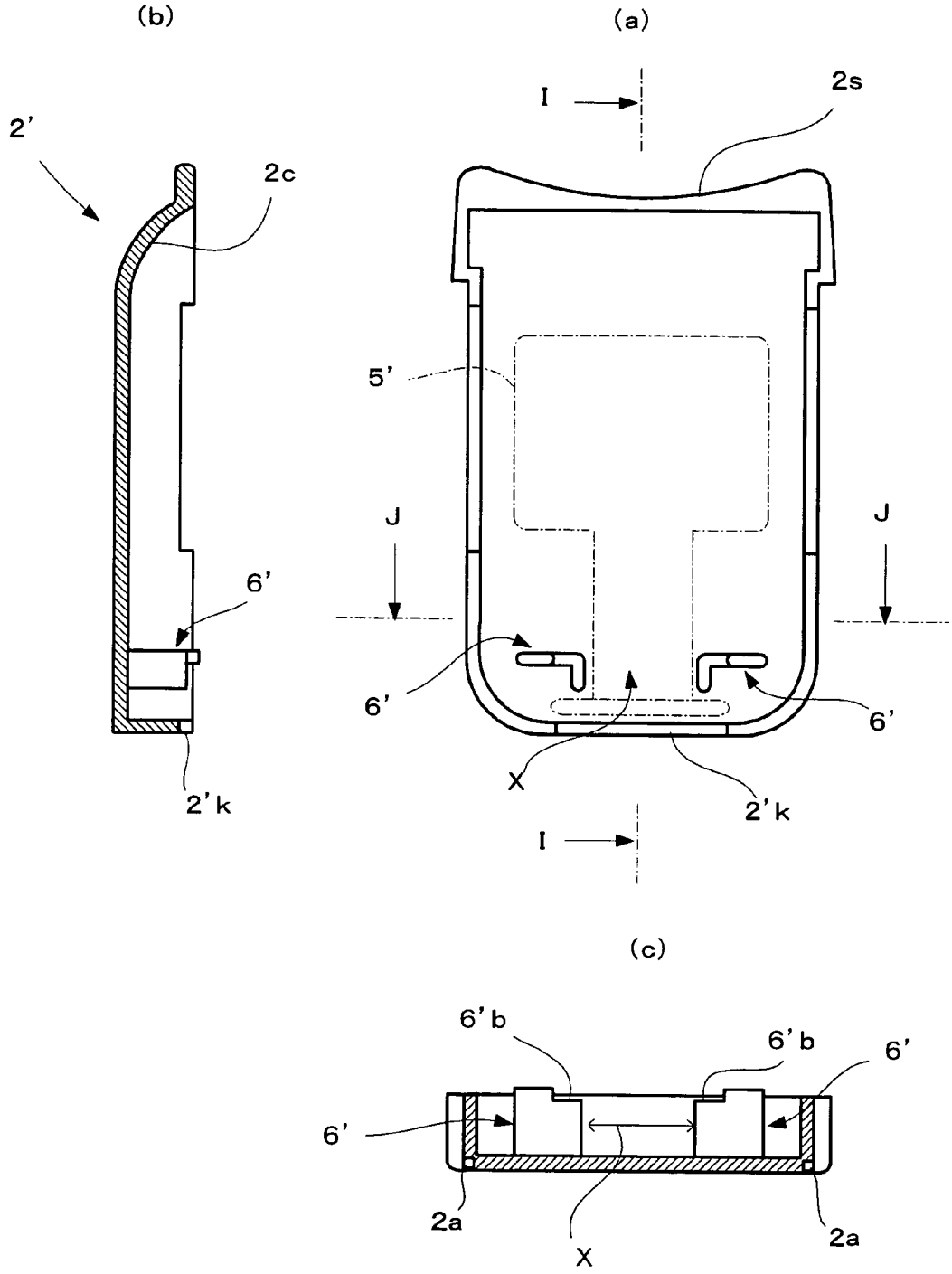
FIG. 9 shows the container body, which is a constituent component of the container for sheet products of FIG. 6, wherein FIG. 9(*a*) is a plan view, FIG. 9(*b*) is a cross-sectional view of FIG. 9(*a*) taken along the line I-I, and FIG. 9(*c*) is a cross-sectional view of FIG. 9(*a*) taken along the line J-J.
Figure 10:
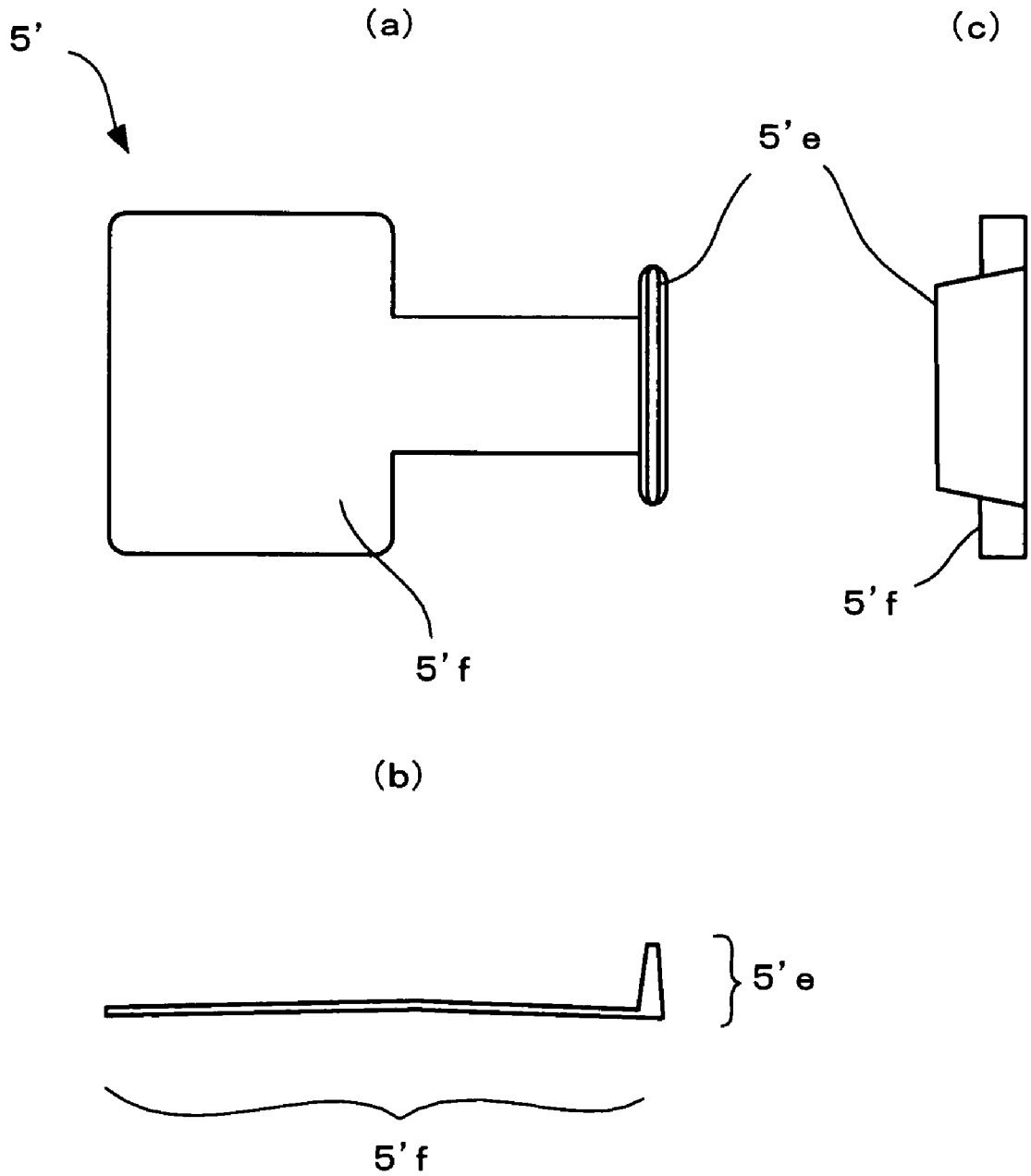
FIG. 10 shows a pressing member, which is a constituent component of the container for sheet products of FIG. 6, wherein FIG. 10(*a*) is a plan view, FIG. 10(*b*) is a side elevation view, and FIG. 10(*c*) is a back elevation view.

An engaging convex portion 8 that extends along the opening/closing direction of the opening/closing lid 3' is provided on the inner surface of the opening/closing lid 3' as shown in FIGS. 7 and 8. The engaging convex portion 8 extends to the rear end of the opening/closing lid 3', with the friction drag member 7 as its bottom end, and it is not provided in the predetermined area of the rear portion of the opening/closing lid 3'. Therefore, when the opening/closing lid 3' is closed, as shown in FIGS. 7(*a*) and 7(*c*), the two parallel ribs, which are the constitutional components of the engaging convex portion 8, and the rising portion 5'*e* are not engaged with each other. Since the center of gravity of the pressing member 5' is in the vicinity of the extending portion 5'*f*, when the engaging convex portion 8 is not engaged in the rising portion 5'*e*, the extending portion 5'*f* is located on the bottom surface of the container body 2'.

When the opening/closing lid 3' is slid open, as shown in FIG. 7(*b*), the engaging convex portion 8 is engaged in the rising portion 5'*e*, so that the rising portion 5'*e* is slanted and the extending portion 5'*f* is shifted from the bottom of the container body 2' toward the friction drag member 7 so that the free end thereof is lifted. This structure allows the extending portion 5'*f* to press the sheet products 4 toward the friction drag member 7.

Due to the backing operation wherein the opening/closing lid 3' is further slid to widen the opening, the sheet products 4 move backward in the container body 2' by the frictional force caused by the friction drag member 7 and come in contact with the partition 6', and this blocks the backward movement of the sheet products 4 as in the first embodiment described above. However, the opening/closing lid 3' is further opened until the friction drag member 7 comes in contact with the partition 6'.

When the opening/closing lid 3' is closed from the fully open condition (i.e., in the fully back condition), the friction drag member 7 has frictional contact with the sheet products 4 and moves forward together with the closing operation of the opening/closing lid 3'. In this case, due to the same principal as in the first embodiment, the topmost sheet of the stacked sheet products 4 is sent out. When the opening/closing lid 3' is closed, the engagement between the engaging convex portion 8 and rising portion is released. This brings the extending portion 5'*f* in contact with the bottom of the container body 2', and therefore the sheet products 4 are no longer pressed against the friction drag member 7.

In the rear end piece of the container body 2' and partition 6', notches 2'*k*, and 6'*b* through which the engaging convex portion 8 can pass are formed respectively. Projecting bars 3'*g*, which function to prevent slipping, are formed on the top surface of the container body 2'.

An interlocking mechanism that makes the pressing member 5' work together with the opening/closing lid 3' is formed so that the pressing member 5' resiliently presses the sheet products 4 toward the opening/closing lid 3' only when the opening/closing lid 3' is in an open position with a predetermined range.

In the engaging convex portion 8, a taper is formed on the end portion edge 8*a* that is opposite to the opening/closing lid opening (FIG. 8(*b*)). The taper allows a smooth engagement between the engaging convex portion 8 and the rising portion 5'*e*. The inclination angle α (FIG. 8(*b*)) of the taper is generally 5 to 60°, and preferably 10 to 40°. By suitably designing the location and inclination angle α of the end portion edge 8*a* of the engaging convex portion 8, the timing for operating the pressing member 5' by opening and closing the opening/closing lid 3' can be optimized. In other words, the location and inclination angle α (i.e., dimensions, location, and angle) of the end portion edge 8*a* of the engaging convex portion 8 are designed so that the opening/closing lid 3' does not pull the sheet products 4 too much in the opening direction when the opening/closing lid 3' is slid open, and so that the sheet products 4 are not pushed out too much when the opening/closing lid 3' is closed.

Although not shown, the engaging convex portion 8 that engages with the rising portion 5'*e* is not limited to a rib shape and may be various other shapes, such as a plate shape. It is possible to form the engaging convex portion 8, for example, by making the entire back surface of the opening/closing lid 3' a bulging shape, or by enlarging the friction contacting portion.

The container for sheet products of the second embodiment of the present invention has the following effects in addition to those achieved by the container for sheet products of the first embodiment.

When the opening/closing lid 3' is closed, since the pressing member 5' does not press the sheet products toward the opening/closing lid 3', it is possible to prevent the sheet products 4 from becoming attached to the opening/closing lid 3'. This feature is particularly advantageous when the sheet products 4 have hygroscopicity and tend to adhere to each other when they become damp.

When a single sheet product 4 is fed out as shown in FIG. 7(*b*) by the opening and closing operation of the opening/closing lid 3', since the sheet products 4 are not pressed toward the friction drag member 7 by the pressing member 5', the single sheet product 4 can be easily removed.

Furthermore, when the opening/closing lid 3' is closed, since the pressing member 5' is not pressing the sheet products 4 any more, plastic deformation of the pressing member 5' is prevented and desired pressing force can be maintained.

Also, since the pressing member 5' is not fixed to the container body 2' and can be simply stored in the container body 2', fabrication thereof is easy.

The invention claimed is:

1. A container for sheet products suitable for taking out each piece of stacked sheet products individually, comprising:

a tray-like container body;

an opening/closing lid slidably mounted on the container body;

a pressing member elastically pressing the sheet products stacked in the container toward the inner surface of the opening/closing lid;

a friction drag member provided on the inner surface of the opening/closing lid to feed out the sheet products in accordance with the closing operation of the opening/closing lid; and a stopper formed in the container body to stop the backward movement of the sheet products by the friction drag member according to the opening operation of the opening/closing lid;

wherein the pressing member comprises a rising portion that rises from the bottom surface of the container body, and an extending portion extending from the bottom end of the rising portion along the bottom surface of the container body, and the pressing member is rotatably disposed so as to press the sheet products toward the friction drag member by shifting the free end of the extending portion from the bottom of the container body toward the friction drag member.

2. A container for sheet products according to claim 1, wherein the pressing member is formed from a plate spring, and the plate spring comprises an attaching end portion attached to the bottom of the container body, a slanting portion extending from the attaching end portion in an inclined manner, and a pressing portion provided on the top of the slanting portion.

3. A container for sheet products according to claim 1, which further comprises an interlocking mechanism for interlocking the pressing member with the opening/closing lid so that the sheet products are resiliently pressed toward the opening/closing lid only when the opening/closing lid is in a predetermined location.

4. A container for sheet products according to claim 1, wherein an engaging convex portion that extends along a predetermined length of the opening/closing lid in the opening/closing direction is provided on the inner side of the opening/closing lid, and the engaging convex portion engages in the rising portion at a predetermined open position of the opening/closing lid and rotates the pressing member.

5. A container for sheet products according to claim 1, wherein the shapes of the container body and the side edge of the opening/closing end of the opening/closing lid are substantially the same and concave as seen in a plan view.

6. A container for sheet products according to claim 1, wherein the sheet products are edible films.

* * * * *